United States Patent [19]

Elias et al.

[11] 4,105,268

[45] Aug. 8, 1978

[54] DOCUMENT HANGING SYSTEM

[76] Inventors: Abram G. Elias, 3300 Skyline Blvd., No. 205, Reno, Nev. 89510; Peter G. Elias, 6 Wedgewood Dr., Winnipeg, Manitoba, Canada, R3T2J8

[21] Appl. No.: 768,360

[22] Filed: Feb. 14, 1977

Related U.S. Application Data

[63] Continuation-in-part of Ser. No. 620,569, Oct. 8, 1975, Pat. No. 4,009,784, which is a continuation-in-part of Ser. No. 514,890, Oct. 15, 1974, Pat. No. 3,923,353, which is a continuation-in-part of Ser. No. 374,007, Jun. 27, 1973, abandoned.

[51] Int. Cl.[2] ..... A47B 63/00; B42F 15/00

[52] U.S. Cl. ..... 312/184; 211/126

[58] Field of Search ..... 312/183, 184; 211/45, 211/46, 50, 54, 89, 113, 124, 126; 24/16 TB

[56] References Cited

U.S. PATENT DOCUMENTS

| | | | |
|---|---|---|---|
| 2,318,077 | 5/1943 | Jonas | 312/184 |
| 2,851,167 | 9/1958 | Rosenberg | 312/184 |
| 3,318,354 | 5/1967 | Borisof | 24/16 TB |
| 3,923,353 | 12/1975 | Elias et al. | 312/184 |

*Primary Examiner*—Casmir A. Nunberg
*Attorney, Agent, or Firm*—O'Brien and Marks

[57] ABSTRACT

A system for hanging documents on rails includes one or more of the following: (1) a plurality of flexible straps having head portions at the opposite ends thereof for passing through respective spaced openings in both document attachment means and a rigid support bar on the rails; (2) adapters on the rails having horizontal flanges with upward extending lips, and flexible document attachment strips with apertures defining hook portions with downward extending tabs supported by the flanges and interlocked with the lips of the flanges; (3) folded flexible document attachment and hanging strips with upper end portions hanging over the rails where the folded edge flares apart to provide stronger end portions; and (4) a document compactor with means interlocking with apertures formed in the rails or adapters.

29 Claims, 42 Drawing Figures

FIG. 2
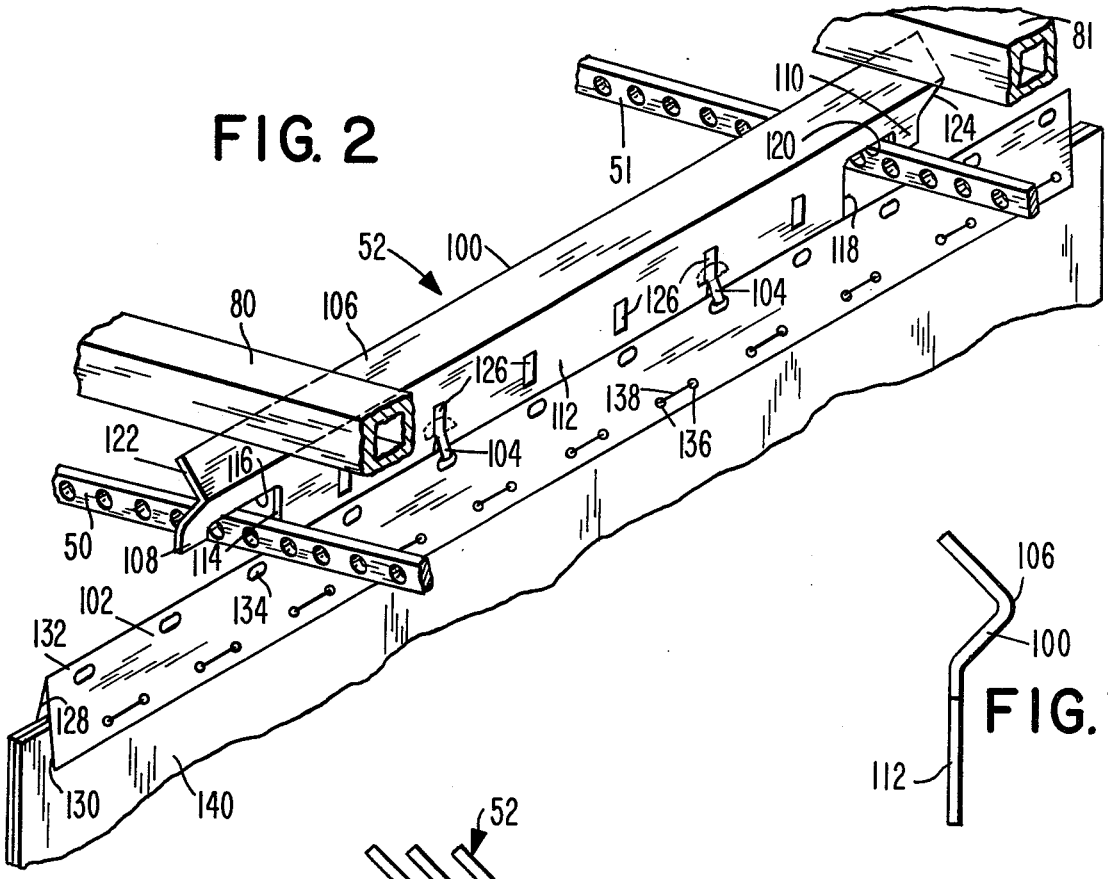
FIG. 3
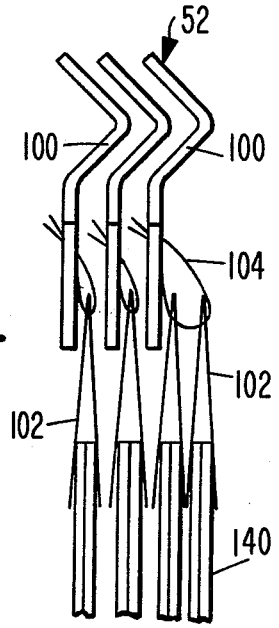
FIG. 4
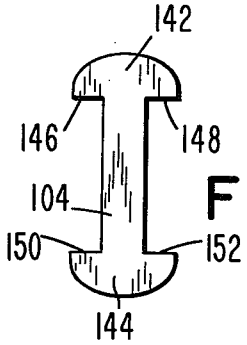
FIG. 5
FIG. 6
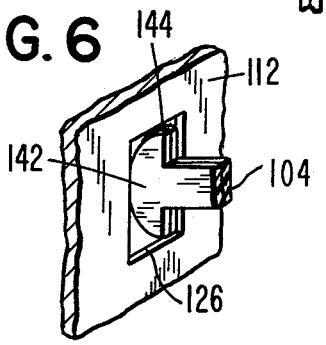
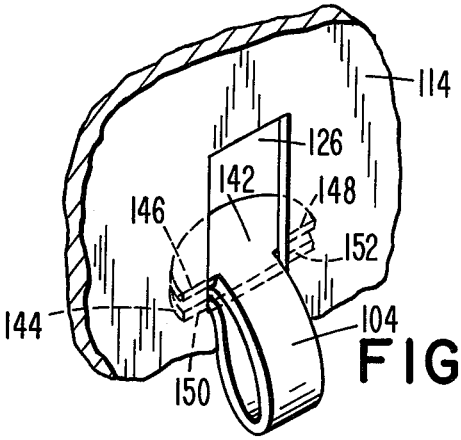
FIG. 7

FIG. 8
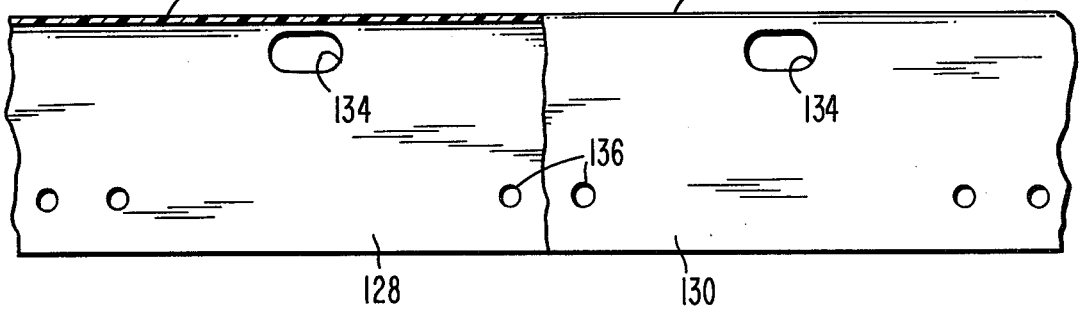
FIG. 9
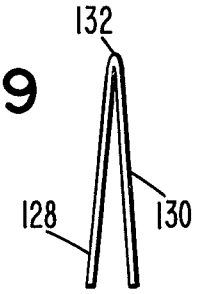
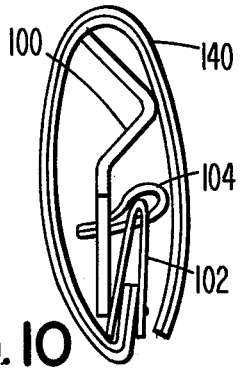
FIG. 10
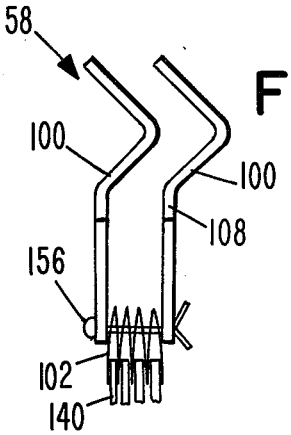
FIG. 11
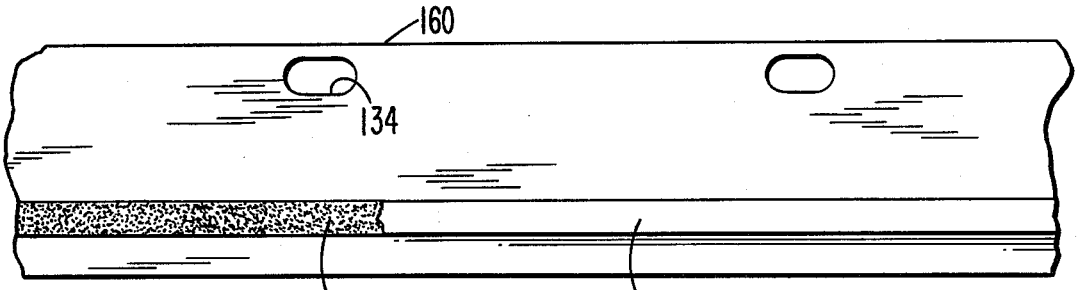
FIG. 12
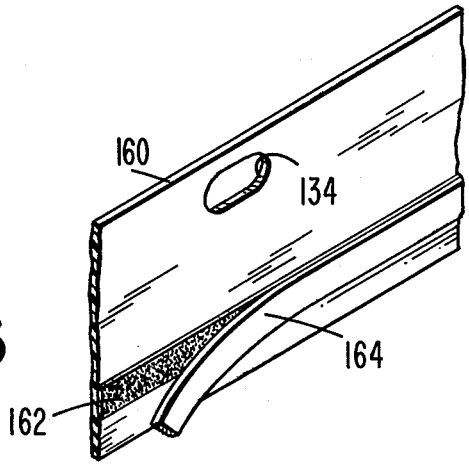
FIG. 13
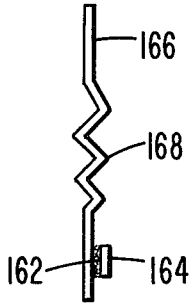
FIG. 14

FIG. 15
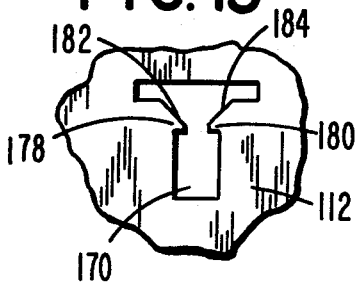
FIG. 16
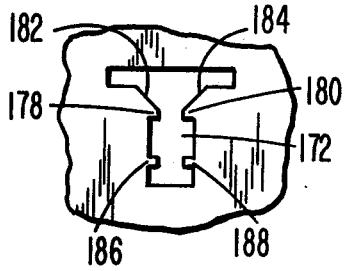
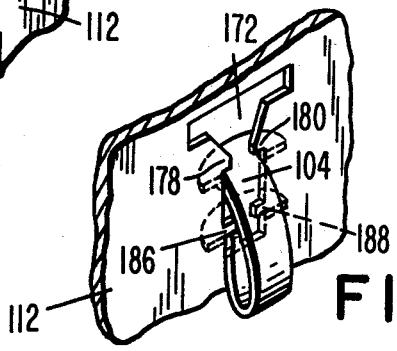
FIG. 17
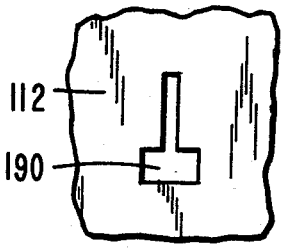
FIG. 18
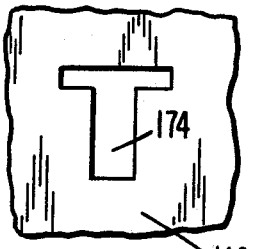
FIG. 19
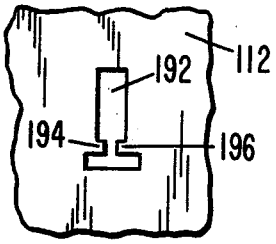
FIG. 20
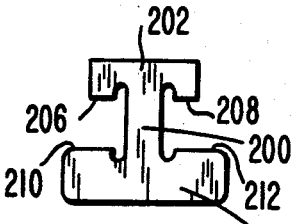
FIG. 21
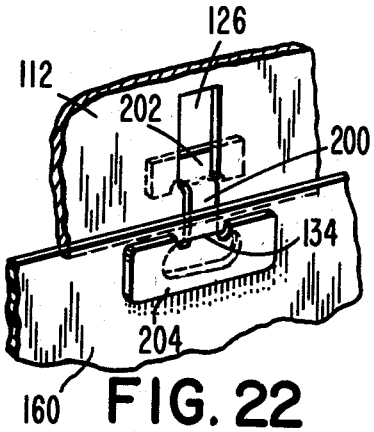
FIG. 22
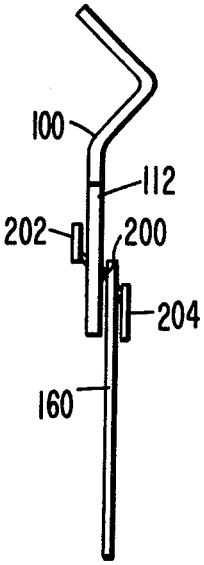
FIG. 23

FIG. 27
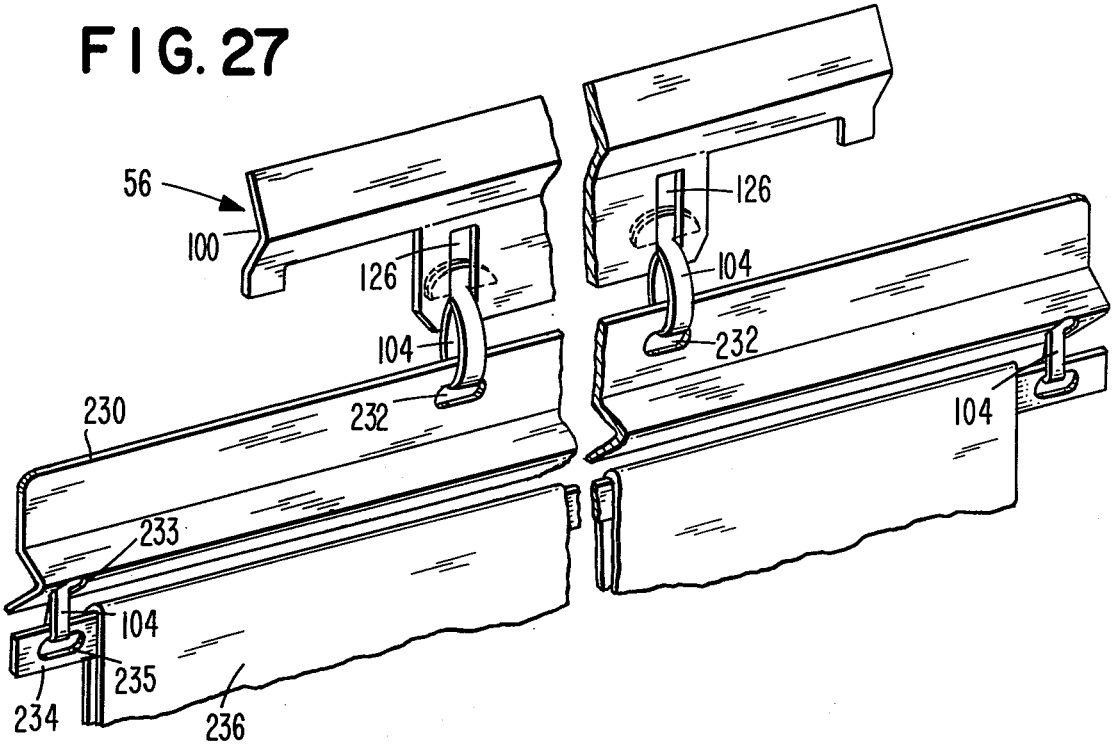
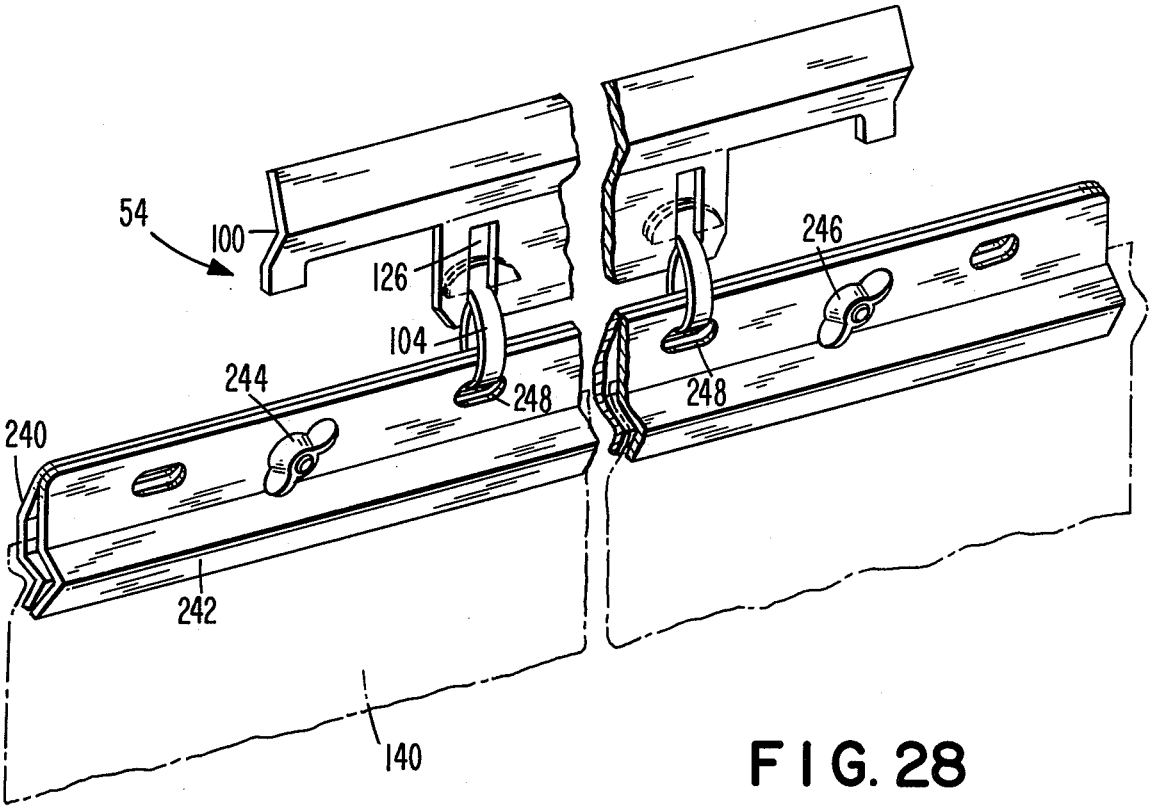
FIG. 28

FIG. 29
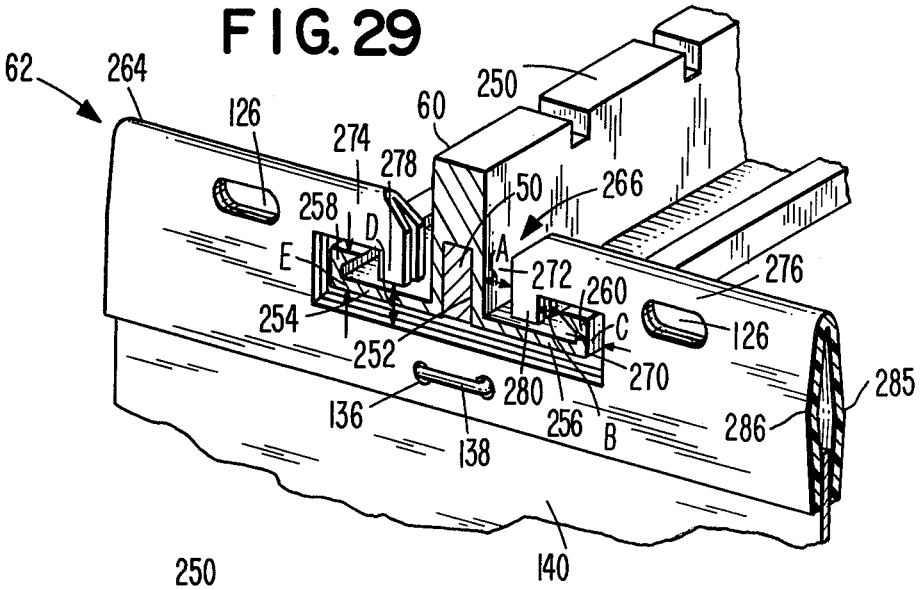
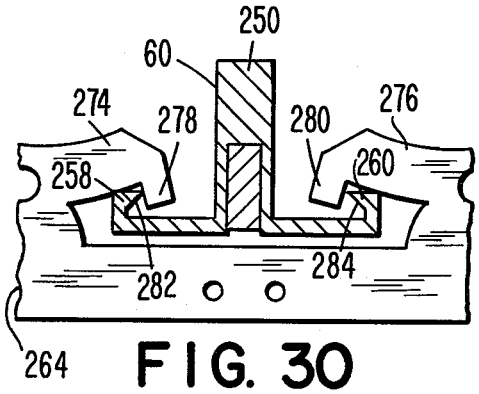
FIG. 30
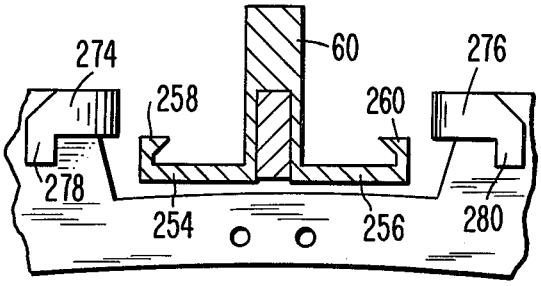
FIG. 31
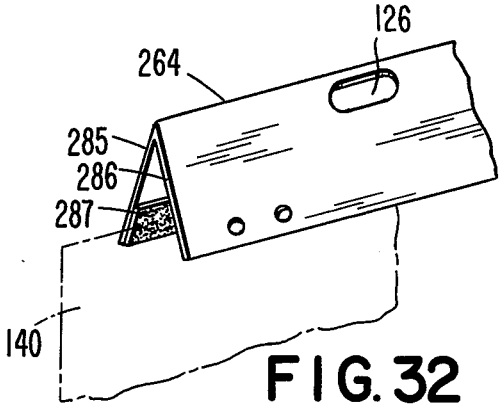
FIG. 32
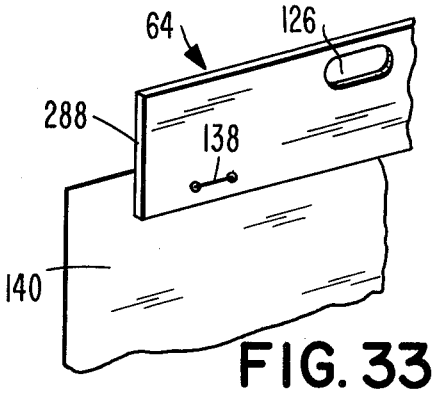
FIG. 33
FIG. 34
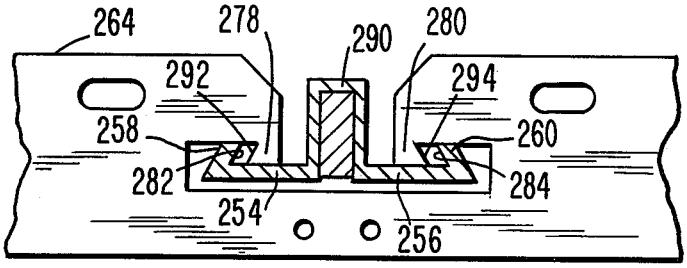

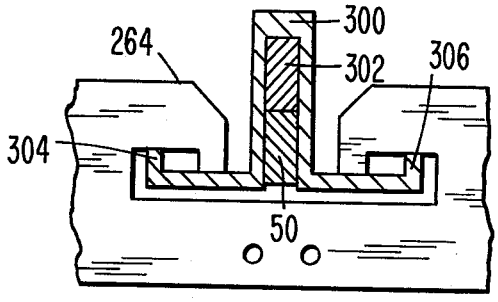
FIG. 35
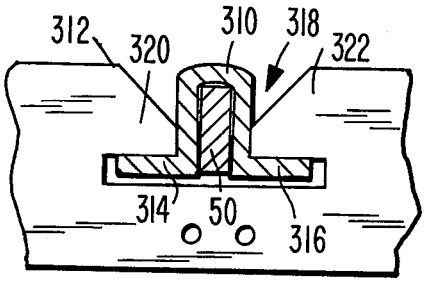
FIG. 36
FIG. 37
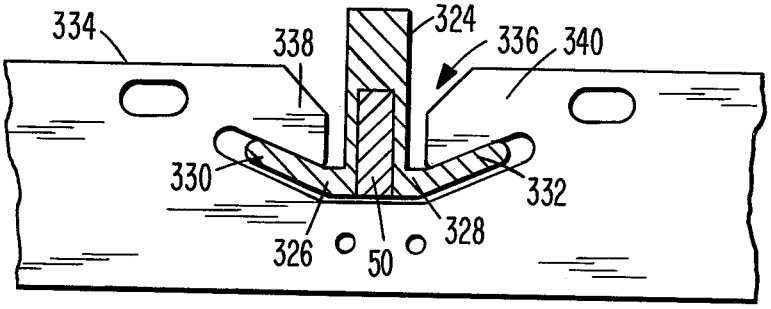
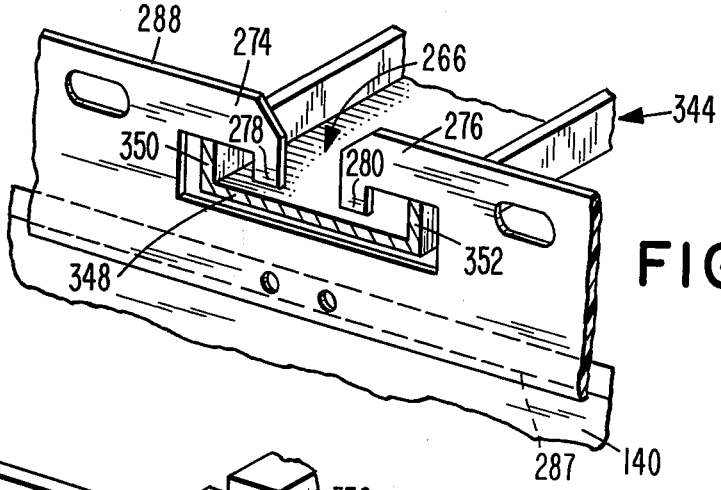
FIG. 38
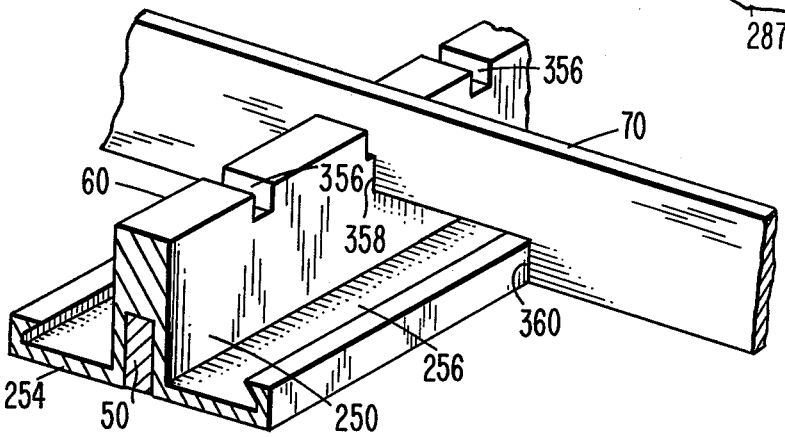
FIG. 39

DOCUMENT HANGING SYSTEM

CROSS-REFERENCE TO RELATED APPLICATIONS

This application is a continuation-in-part or our copending application Ser. No. 620,569 filed Oct. 8, 1975, now U.S. Pat. No. 4,009,784 for "Documenting Hanging Apparatus" which was a continuation-in-part of our application Ser. No. 514,890 filed Oct. 15, 1974, now U.S. Pat. No. 3,923,353, which in turn was a continuation-in-part of our application Ser. No. 374,007 filed June 27, 1973 (abandoned).

This application is also related to our application Ser. No. 619,568 filed Oct. 6, 1975 for a design "Document Hanger." Further, this application is related to our application Ser. No. 327,743 filed Jan. 29, 1973 for "Means For Filing Documents", now U.S. Pat. No. 3,850,488 which was a continuation-in-part of our application Ser. No. 238,040 filed Mar. 27, 1972 (abandoned) and for which a reissue application Ser. No. 735,100 has been filed on Oct. 26, 1976. These applications and patents are hereby incorporated herein.

BACKGROUND OF THE INVENTION

1. Field of the Invention

This application relates to systems and apparatus for hanging documents, such as drawings, maps, newspapers, magazines, etc., on horizontal rails.

2. Description of the Prior Art

The prior art discloses rigid document hanging bars for extending across rails with various means for attaching documents thereto, such as flexible strips or strings or flexible tangs of a fastener threaded through aligned holes in the bar and documents as disclosed in U.S. Pat. No. 3,298,374 and in French Pat. No. 731,238. These prior art hanging apparatus with rigid hanging bars suffer from one or more deficiencies such as being relatively difficult to attach or remove a document from the hanger, requiring expensive fasteners, requiring an excessive amount of space, etc. In our U.S. Pat. No. 3,850,488 there is disclosed a strip-like rigid hanger with a flexible lower portion from which flexible straps with single heads at one end of the straps are severed, the other ends of the straps remaining attached to the document support portion, wherein the straps pass through holes in a document and the heads are interlocked with the slots left by the severed straps in the lower portion to secure the document to the hanger; this document hanger while presenting a substantial improvement over the prior art is difficult to manufacture and the heads of the straps tend to come out of the upper keyed ends of the slots during handling of the hanger and document.

Also disclosed in the prior art are various other non-related types of fastening devices, such as a filament with heads or cross-bars at the opposite ends thereof for attaching tags to garments or the like disclosed in U.S. Pat. No. 3,765,110 or a double headed strap for a key case such as disclosed in U.S. Pat. No. 2,564,382. Generally, these non-related types of fastening devices are inapplicable or unsuitable for hanging documents on support bars.

Strips fastened to the top edges of documents with holes in the strips for being placed on horizontal telescoping pins and tubes to support the documents are disclosed in U.S. Pat. No. 2,205,903. To remove a selected document, the documents in front of the selected document must be removed first from the tubes; this increases the time and difficulty of obtaining the selected document from a file. Relatively rigid strips with apertures forming hook-shaped openings for hooking over rails are disclosed in U.S. Pat. No. 2,969,793 and Switzerland Pat. No. 349,954 while more complex shape openings or hooks are formed in rigid strips disclosed in U.S. Pat. No. 3,208,457, French Pat. No. 1,219,080, and Netherlands Pat. No. 6,706,044; documents with these hanging strips having hook-like formations therein are subject to falling from the rail or rails upon which they are supported by being moved or tilted during handling or removing of adjacent files. U.S. Pats. No. 1,832,239 and No. 1,878,177 disclose flexible tabs on the top edges of documents with holes in the tabs and slits extending from the hole to the top of the tabs so that the fastener may be flexed to receive a support rod in the hole; documents hung by these tabs tend to fall off of the support rods. A substantial improvement in a flexible hanging strip is disclosed in our U.S. Pat. No. 2,923,353 wherein a folded flexible strip has openings formed therethrough for receiving the rails with a slit extending from one side of the opening to the upper folded edge of the strip.

Rigid hangers, such as those disclosed in U.S. Pat. No. 2,678,651, Great Britain Pat. No. 1,153,729 and our U.S. Pat. No. 3,850,488 employ rigid bars with end portions which are notched to extend over spaced horizontal rails. Documents on these rigid hangers are removed from the rails either by lifting upward between the rails or by lifting at least one of the bar from one rail moving the bar toward one side, and rotating the bar to bring the lifted end underneath the one rail so that the bar and document may be removed sideways beneath the rail.

It is noted that the above mentioned U.S. Pat. No. 1,878,177 also discloses riders or spacers with notches receiving the support rods for moving or compacting documents on the supporting rods. However, this rider cannot be secured to hold the documents compacted against an end or intermediate position on the supporting rods.

Further, various supports for rails mounted on walls or in cabinets are disclosed in U.S. Pats. No. 1,878,177 and 2,935,204.

SUMMARY OF THE INVENTION

The invention in a first aspect is summarized in a document hanging system for use in hanging documents upon a pair of spaced horizontal rails, the system including a rigid strip-like supporting bar having an upper load carrying portion with ends adapted to overhang and be supported by the rails, the width of the supporting bar extending vertically, the supporting bar having a lower document supporting portion with a plurality of spaced openings extending downward between the rails, document attachment means having a plurality of spaced openings with the same spacing as the supporting bar openings, a plurality of flexible straps each having head portions at the opposite ends thereof and passing through the corresponding openings in both the supporting bar and document attachment means, the head portions of each strap interlocking with at least one of the corresponding openings in the supporting bar and document attachment means.

An object of the invention is to construct a document hanging system which is reliable and relatively less expensive.

Another object of the invention is to provide a document hanging system wherein the documents can be closely packed together.

It is also an object of the invention to provide a document hanging system wherein various hanging apparatus may be selected for hanging documents in accordance with the size, weight, or quantity of the documents.

A further object of the invention is to provide a document hanging system wherein documents of different widths are supported by rail hanging bars of a single length.

An advantage of the invention is that the use of a plurality of flexible straps with heads interlocking with openings in a support bar or document attachment means provides for flexibility as well as being easily removable and occupying a relatively small amount of space.

In another aspect of the invention, rail means with horizontal flanges extending from opposite sides thereof is employed together with a strip of tough resilient flexible material fastened on the upper edge of a document with apertures in the strip forming wing portions extending over the flanges to support the document, the flanges having upward extending lips from the outer edges thereof interlocking with downward extending tabs on the inner edges of the wing portions of the strip.

In still another aspect of the document hanging arrangement, adapters with a longitudinal slot for receiving rails and with opposite horizontal flanges are provided for hanging flexible document attachment strips having wing portions extending over the flanges of the adapter.

A further feature of the invention contemplates the employment of a flexible hanging strip which is folded at its upper edge and has hook end portions which extend over the rails with folded halves thereof flaring apart to support a document attached to the central portion.

In a still further feature of the invention, there is provided a strip-like compactor which includes means for interlocking with apertures in either the rails or rail adapters to hold a plurality of documents in a compact condition.

Other objects, advantages, and features of the invention will be apparent from the following description of the preferred embodiment taken in conjunction with the accompanying drawings.

BRIEF DESCRIPTION OF THE DRAWINGS

FIG. 2 is a perspective view of a large-document hanging apparatus in the system of FIG. 1. FIG. 3 is a side view of a rigid document supporting bar used in the apparatus of FIG. 2.

FIG. 4 is a side view showing a plurality of the hanging apparatus of FIG. 2 nested together.

FIG. 5 is a plan view of a hanging strap used in the apparatus of FIG. 2

FIG. 6 is a perspective view of a broken away portion of the support bar and the hanging strap illustrating the assembly of the hanging strap with the support bar.

FIG. 7 is a perspective view similar to FIG. 6 but after the strap has been assembled.

FIG. 8 is a front view of a document attachment strip, partially broken away, used in the apparatus of FIG. 2.

FIG. 9 is a side view of the attachment strip of FIG. 8.

FIG. 10 is a side view of the hanging apparatus of FIG. 2 with the document rolled up.

FIG. 11 is a side view of an apparatus for hanging a large bundle of documents in the system of FIG. 1.

FIG. 12 is a front view of a variation, partially broken away, of the document attachment strip of FIG. 8.

FIG. 13 is a perspective view of the strip variation of FIG. 12.

FIG. 14 is a side view of a further variation of the document attachment strip.

FIG. 15 is a front view of a modification of the openings in the support bar of FIG. 2.

FIG. 16 is a front view of second modification of the openings in the support bar of FIG. 2.

FIG. 17 is a perspective view of a broken away portion of the support bar showing the modification of FIG. 16 with a hanging strap assembled therein.

FIG. 18 is a front view of a broken away portion with a third modification of the openings in the support bar of FIG. 2.

FIG. 19 is a front view of a fourth modification of the openings of the support bar of FIG. 2.

FIG. 20 is a front view of a fifth modification of the openings in the support bar of FIG. 2.

FIG. 21 is a plan view of a modification of the hanging strap of FIG. 5.

FIG. 22 is a perspective view of a broken away portion of the support bar and attachment strip together with the modified hanging strap of FIG. 21.

FIG. 23 is a side view of the hanging apparatus with the modified hanging strap of FIGS. 21 and 22.

FIG. 27 is a perspective view of a hanging apparatus, with a center portion broken away, for folded documents in the system of FIG. 1.

FIG. 28 is a perspective view of a clamp-type hanging apparatus for a bundle of documents in the system of FIG. 1.

FIG. 29 is a perspective view of a broken away portion of an apparatus for hanging single sheets or small groups of documents in the system of FIG. 1.

FIG. 30 is a front view partially in cross-section illustrating interlocking features of the apparatus of FIG. 29.

FIG. 31 is a view similar to FIG. 30 but illustrating the removal or assembly of a combination hanging and attachment strip on a rail adapter.

FIG. 32 is a perspective view of a variation of the fastening of a document to the hanging and attachment strip of FIG. 29.

FIG. 33 is a perspective view of a modification of the combination hanging and attachment strip of FIG. 29.

FIG. 34 is a front view, partially in cross section, of a variation of the adapter and combination hanging and attachment strip of FIG. 29.

FIG. 35 is a front view, partially in cross section, of a second variation of the rail adapter and the combination hanging and attachment strip of FIG. 29.

FIG. 36 is a front view, partially in cross section, of a third variation of the rail adapter and the combination attachment and hanging strip of FIG. 29.

FIG. 37 is a front view, partially in cross section, of a fourth variation of the rail adapter and combination hanging and attachment strip of FIG. 29.

FIG. 38 is a perspective view of a modified rail with the combination hanging and attachment strip of FIG. 33.

FIG. 39 is a perspective view of a compactor for the documents supported on the rail adapters in the system of FIG. 1.

DESCRIPTION OF THE PREFERRED EMBODIMENT

Figure 1:
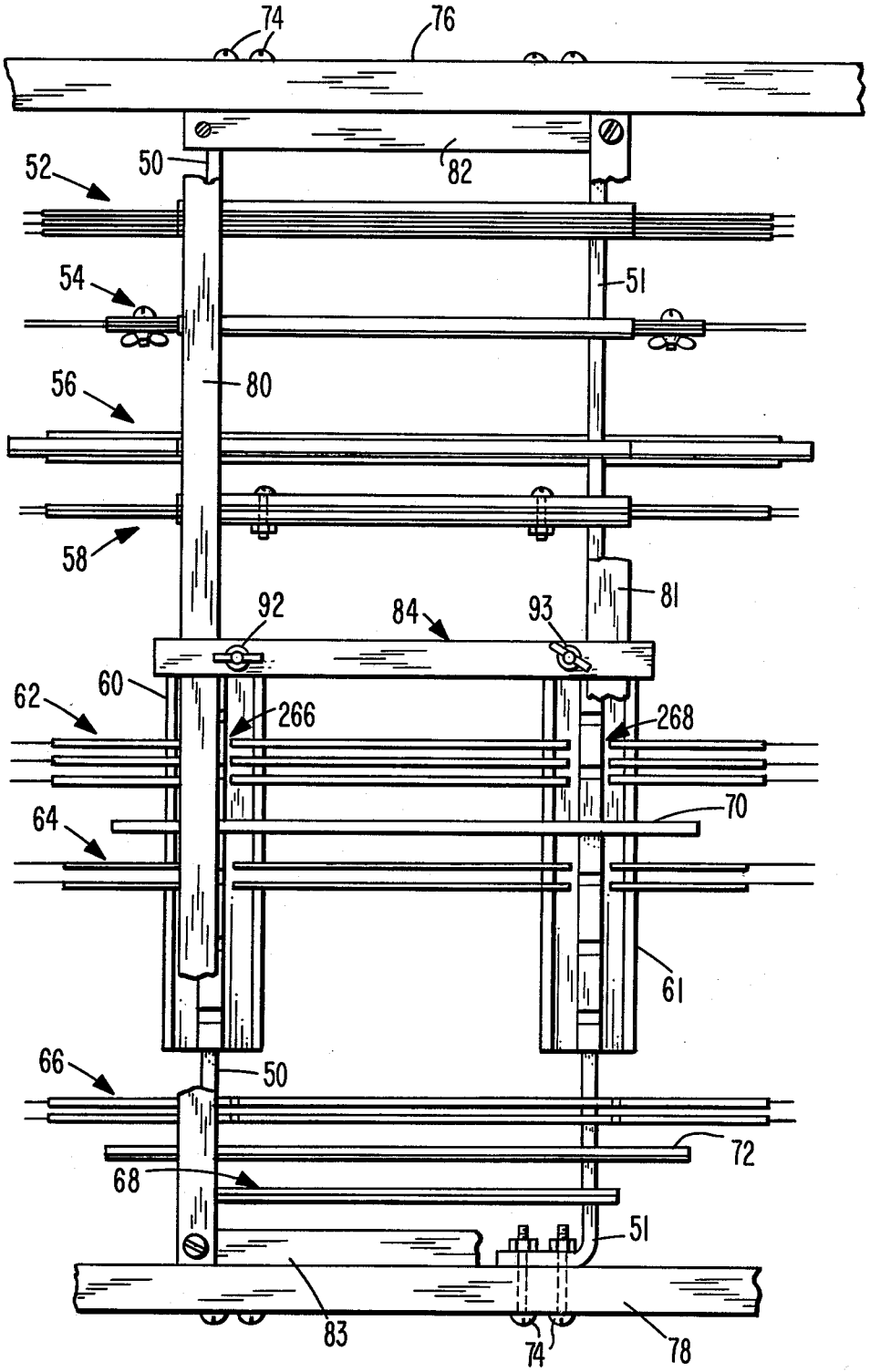
FIG. 1 is a plan view of a document hanging system in accordance with the invention.

As illustrated in FIG. 1 the invention is embodied in a document hanging system including a pair of parallel rails 50 and 51 extending in a horizontal plane and upon which different hanging apparatuses are hung to support various sizes and arrangements of documents. Large document hanging apparatus indicated generally at 52, shown in detail in FIG. 2, supports large documents or medium size bundles of documents on the rails 50 and 51 while a clamp-type hanging apparatus indicated generally at 54, shown in detail in FIG. 28, supports larger bundles of documents. A folded document hanging apparatus indicated generally at 56, shown in detail in FIG. 27, on the rails 50 and 51 supports folded documents such as newspapers, magazines, or the like. Also large bundles of documents can be supported on the rails by apparatus indicated generally at 58 and shown in more detail in FIG. 11. A pair of adapters 60 and 61 on the rails 50 and 51 support improved single or small group document hanging apparatus indicated generally at 62 and 64, shown in detail in FIGS. 29 and 33, while the document hanging apparatus 66 described in our U.S. Pat. No. 3,923,353 is hung directly on the rails 50 and 51; this latter apparatus 66 is not described in detail in this application. There is also included another new single or small group document hanging apparatus indicated generally at 68, shown in detail in FIGS. 40 and 41, for hanging directly on the rails 50 and 51. The hanging system further includes locking compactor bar 70, shown in detail in in FIG. 39, for use in the section employing the rail adapters 60 and 61, and a locking compactor bar 72, shown in detail FIG. 42, for use directly on the rails 50 and 51.

Figure 24:
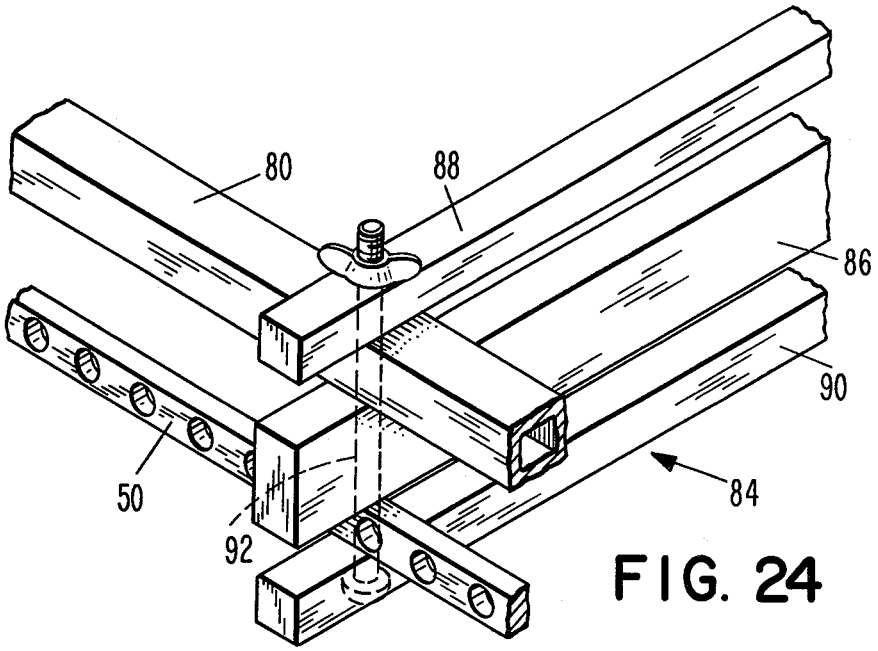
FIG. 24 is a perspective view of a broken away portion of one rail and load carrying support structure employed in the system of FIG. 1.
Figure 25:
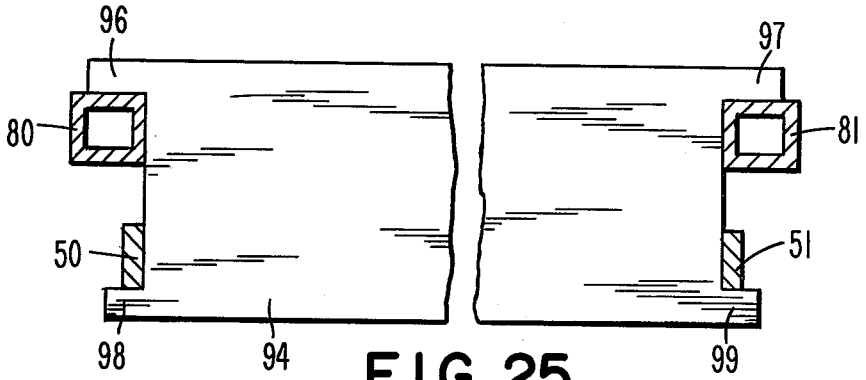
FIG. 25 is a front view partially broken away illustrating a variation of a connecting member in the supporting structure of FIG. 24.

The rails 50 and 51 are mounted in a conventional manner, such as by bolts 74, on opposite walls 76 and 78 of a cabinet. Other conventional mounting arrangements such as brackets mounted on a wall of a room, a movable cart, etc. can also be used. Reinforcing means for the rails 50 and 51 include a pair of reinforcing bars 80 and 81 extending parallel and above the rails 50 and 51 with the ends thereof fastened to cross bars 82 and 83 which rest on the ends of the rails 50 or alternately are secured to the walls 76 and 78. A structure indicated generally at 84 is positioned midway or at a selected position on the length of the rails 50 and 51 and the reinforcing bars 80 and 81 to connect the rails 50 and 51 to the reinforcing bars 80 and 81. For longer lengths of rails, several connecting structures 84 may be used. As shown in FIG. 24 the structure 84 includes a center bar 86 determining the spacing between the reinforcing bar 80 and rail 50 together with an upper bar 88 extending on top of the reinforcing bar 80 and a lower bar 90 extending beneath the rail 50 with bolts 92 and 93, FIG. 1, securely clamping the bars 88 and 90 on the upper side of the reinforcing bar 80 and on the lower side of the rail 50 to secure them together. Alternately as shown in FIG. 25, the structure connecting the reinforcing bars 80 and 81 with the rails 50 and 51 includes an elongated plate-like member 94 which has upper tangs 96 and 97 for engaging the upper sides of the bars 80 and 81 with lower tangs 98 and 99 for engaging the undersides of the rails 50 and 51; the plate-like member 94 being a strong rigid material capable for providing the necessary connection between the rails 50 and 51 and the reinforcing bars 80 and 81.

The large document hanging apparatus 52, as shown in FIG. 2, includes a horizontal elongated supporting bar or member 100, a flexible combination hanging and attachment strip 102 and a plurality of flexible straps 104 connecting the supporting bar 100 to the flexible strip 102.

The support bar 100, FIGS. 2 and 3, is formed from a strip-like material, such as a strip of extruded or stamped metal or other relatively rigid structural material of adequate strength, and has its width extending vertically with an upper portion 106 which is formed concavo-convex throughout its length and which at its ends extends above the rails 50 and 51. Tabs 108 and 110 extend downward from the outside ends of the upper portion 106 on the outsides of the rails 50 and 51 to form hook ends over the rails 50 and 51 while a planar document supporting portion 112 of the support bar 100 extends downward from a central portion of the upper portion 106 between the rails 50 and 51. The inner edge of the tab 108 together with the left edge 114 of the document support portion 112 define opposite sides of a notch 116 which has a top border defined by the upper support portion 106 resting upon the rail 50 which is received within the notch 116; similarly the inner edge of the tab 110 together with the right edge 118 of the document supporting portion 112 define opposite sides of a notch 120 which has its upper border defined by the upper portion 106 resting upon the rail 51 received in the notch 120. The distance between the right edge 118 of the document supporting portion 112 and the left end 122 of the support bar 100 is less than the distance between the rails 50 and 51; similarly the distance between the left edge 114 of the document supporting portion 112 and the end 124 of the support bar 100 is also less than the distance between the rails 50 and 51. The document supporting portion 112 has a plurality of spaced enclosed openings 126 which are oblong in the vertical direction and through which the straps 104 pass.

The attaching strip 102, FIGS. 2, 8, and 9 is formed from a tough, flexible, resilient material, such as oriented polyester or the like, and has halves 128 and 130, FIG. 9, which are folded about a fold line 132 defining the upper edge of the member 102. Enclosed openings 134 are formed through the folded halves 128 and 130 near the top edge of the member 102 for receiving the straps 104; the openings 134 having the same spacing as the openings 126 formed in the support bar 100. Additionally, pairs of openings 138 are formed at spaced locations near the bottom edges through the halves 128 and 130 of the member 102 for permitting staples 138 to pass through the strips 102 to secure a document or a plurality of documents 140 between the folded halves 128 and 130. The openings 134 are shown as being elongated in the horizontal dimension.

The straps 104, FIGS. 2, 5, 6 and 7, are likewise formed from a tough, flexible, resilient material such as oriented polyester, and have head portions 142 and 144 formed on the opposite ends thereof. The strap 104 between the head portions 142 and 144 has a width slightly less than the width of the openings 126 in the support bar 100 and also less than the horizontal dimension of the openings 134 in the attaching strip 102. The head portion 142 forms shoulders 146 and 148 on opposite sides of the strap 104 while the head portion 144 forms shoulders 150 and 152 on opposite sides of the strap 104 for engaging the supporting portion 112 on opposite sides of the opening 126 as illustrated in FIG. 7. The head portions 142 and 144 have a width less than the longitudinal, i.e., vertical, dimension of the openings 126 so that the head portions 142 and 144 may be twisted into a vertical orientation and inserted through an opening 126 as shown in FIG. 6. The length of the strap 104 between the head portions 142 and 144 is selected to hang the document below the bar 100 so that the top edge 132 of the attachment strip 102 can extend underneath the rails 50 and 51.

The concavo-convex structure of the upper portion 106 of bar 100 and the spacing of the edges 114 and 118 of the lower depending document supporting portion 112 from the opposite ends 122 and 124 is disclosed in our U.S. Pat. No. 3,850,488 and serves substantially the same functions of reinforcing the bar 100 and permitting the bar to be removed from below the rails 50 and 51 as described in such patent.

The employment of the openings 126 with vertically oblong dimensions, with the double headed flexible straps 104 and with the attachment strip 102 offers an advantage over the prior hanging apparatus in that the strap portions 104 have less tendency to accidentally be removed from the openings 126 since the bar 100 has means preventing their removal, i.e. a horizontal width less than the width of heads 142 and 144 throughout their vertical dimension. The straps disclosed in our U.S. Pat. No. 3,850,488 tended to be resiliently biased toward the top of the slot where the heads could easily open through the enlarged portion at the top of the opening. In the present arrangement the shoulder portions 146, 148, 150 and 152 engaging the document supporting portion 112 on opposite sides of the opening 126 prevents the strap portions 104 from being accidentally disengaged from the openings 126.

Additionally, the strip 102 protects the upper edge of the document 140. The upper edge of the document 140 is subject to abuse and can be easily ripped or torn or bent preventing proper hanging of the document; by including the tough flexible resilient strip 102 secured to the upper edge of the documents 140, the upper edges of the documents are protected from such abuse.

Further by using the straps 104 with the attachment strips 102 to hang the documents 140 below the rails 50 and 51, only one length of bar 100 is needed. Both narrow documents which extend only below the central portion of the bar 100 and wide documents which extend underneath and past the rails 50 and 51 can be hung on the same length of bar.

As illustrated in FIG. 4, a plurality of the hanging apparatus 52 can be nested together supporting respective groups of documents 140 with the strip members 102 attached to the upper edges thereof and the straps 104 passing through the openings in the support members 100 and strip members 102. The straps 104 being of planar material as well as the strips 102 being of generally planar material do not significantly increase the separation of the members 100 or documents 140 on the rails; thus the plurality of hanging apparatus 52 can closely hang a large number of documents in a small space. Also, it is noted that the straps 104 can be used to hang two or more of the strips 102 with documents attached thereto on a single support bar 100. Additionally, the straps 104 can be easily disconnected from the support bar 100 by twisting until the head portions 142 and 144 are vertical and pulling through the slots 126 so that the documents may be passed through a reproducing machine.

As shown in FIG. 10 the documents can be rolled around the bar 100 to be carried easily from place to place. The flexibility of the straps 104 and the strip members 102 permits the rolling up of the documents without significant interference.

The large bundle hanging apparatus 58 is illustrated in detail in FIG. 11 and includes a pair of the support bars 100 between which the attachment strips 102 fastened on the top edges of a plurality of documents 140 are sandwiched. Fasteners 156 extend through two or more of the openings 126, FIG. 2, of the bars 100 and through the openings 134, FIG. 8, of the attachment strips 102 to secure the pair of support bars 100 together with the attachment strips 102 sandwiched therebetween and supporting the large bundle of documents 140.

Variations 160 and 166 of the attachment strip are shown in FIGS. 12, 13 and 14 wherein the attachment strip is formed from a heavy unfolded strip of tough resilient flexible material such as oriented polyester. The strips 160 and 166 include a strip of adhesive 162 with a releasable cover strip 164 thereon for use in attaching the upper edge of a document thereto. In FIG. 14 the strip variation 166 has a plurality of ribs 168 formed along the length of the strip to increase the stiffness of the strip 166, this increased stiffness tends to prevent the upper edge of a document secured to the strip 166 from folding over due to the weight and horizontal width of the document which can extend a relatively large horizontal distance past the bar 100.

Modifications of the strap receiving openings formed in the document support portion 112 of the support bar are illustrated in FIGS. 15, 16, 17, 18, 19 and 20. Openings 170, 172 and 174 in FIGS. 15, 16 and 19, respectively, have lower vertically elongated portions with a width sufficiently large to receive the straps 104 horizontally but sufficiently small to prevent the head portions of the straps 104 from passing through such vertically elongated portions, and have upper horizontally elongated portions which permit the head portions of the straps 104 to be inserted therein while in a horizontal position instead of requiring twisting to the vertical position as with the opening 126 of FIG. 6. In FIGS. 15 and 16 projections 178 and 180 partially close the upper end of the lower vertically elongated portion of the openings 170 and 172 to prevent the strap 104 from moving up into the upper horizontally elongated portion of the opening 170 and 172. Inwardly and downwardly sloping surfaces 182 and 184 formed on the upper edges of the projections 178 and 180 to the horizontally elongated opening 172 aid in twisting the straps 104 from a horizontal orientation to an inclined orientation to move from the top portion to the bottom portion of the openings 170 and 172. In FIGS. 16 and 17 additional projections 186 and 188 extend into an intermediate portion of the lower vertically elongated portion of the opening 172 to form means securing the lower half of the strap 104 in the lower portion of the slot 172. In FIGS. 18 and 20 openings 190 and 192 include lower portions which have a width sufficient to accomodate the width of the strap 104 but prevent the heads from passing and have upper narrow vertically extending elongated portions sufficient to receive the width of the head portions of the strap 104 when twisted to a vertical orientation; the straps 104 are inserted into the openings 190 and 192 in a manner similar to that shown in FIG. 6. Projections 194 and 196 extend into the opening 192 between the lower and upper portions thereof to further increase the security of the strap 104 when positioned in the lower portion.

A modified strap 200 shown in FIG. 21 is similar to the strap 104 of FIG. 5 in that the strap 200 has head portions 202 and 204 at the opposite ends thereof and is formed from a tough resilient flexible material such as oriented polyester. The head portion 204 is larger than the head portion 202 and is designed to interlock with the opening 134 through the strip attachment member such as the strip 160. The head portion 202 interlocks with the opening 126 in the document supporting portion 112 of the supporting bar. The shoulders formed by the head portion 202 on opposite sides of the strap 200 have extensions 206 and 208 extending parallel to the strap 200 toward the other head portion 202 while the head portion 204 has similar extensions 210 and 212 of the shoulders extending on opposite sides of the strap 200 a short distance toward the head portion 204. These extensions 206, 208, 210 and 212 form opposite hook portions on the heads 202 and 204 hooking over the bottom and top edges, respectively, of the openings 126 and 134. Also these extensions 206, 208, 210 and 212 increase the size of the head portions 202 and 214 and overlap the opposite sides of the respective document support portion 112 of the support bar 100 and the attachment strip 160 to decrease the possibility of pulling the head portions 202 and 204 through the respective openings 126 and 134.

Figure 26:
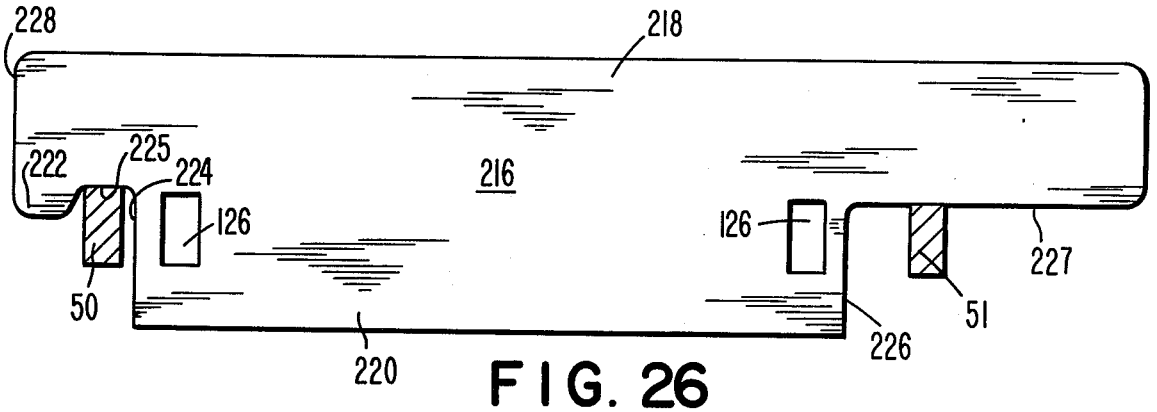
FIG. 26 is a front view of a variation of the support bar of FIG. 2.

As shown in FIG. 26, a variation 216 of the support bar includes an upper supporting portion 218 extending above the rails 50 and 51 and a lower document hanging portion 220 extending downward from the center portion of the upper support portion 218 between the rails 50 and 51. A downward extending tab 222 is formed only at one end of the upper support portion 218 to extend downward outside of the rail 50 while the other end of the upper supporting portion 218 is free of any downward extending tab. The inner edge of the tab 222 and the left edge 224 of the document hanging portion 220 form the opposite sides of a notch 225 receiving the rail 50 while the bottom edge 227 of the other end of the upper portion 218 rests on the rail 51. The right edge 226 of the document hanging portion 220 is spaced from the left end 228 of the bar 216 by a distance less than the distance between the rails 50 and 51 so that it can be removed below the rails 50 and 51 in a manner similar to the bar 100 of FIG. 2. The bar 218 is also planar throughout and formed from a sufficiently rigid and strong material to support documents hung from the openings 126 by the straps 104.

The folded document hanging apparatus 56, illustrated in FIG. 27, includes the support bar 100 together with a long horizontal strip-like support bar 230 which has at least a pair of openings 232 spaced in an intermediate portion for receiving the straps 104 received in the bar 100 to hang the long bar 230. The long support bar 230 has vertically elongated openings 233 similar to the openings 126 at the opposite ends of the bar 230 to secure heads of straps 104 which also pass through openings 235 in the opposite ends of a fold bar 234 over which a folded document such as a newspaper 236 is hung. It is noted that the long support bar 230 has a concavo-convex structure throughout its length in its vertical width dimension.

Illustrated in FIG. 28 are the details of the clamp hanging apparatus 54 which includes the support bar 100 together with a pair of clamping members 240 and 242 which can be clamped together by bolts 244 and 246 and which are hung by the straps 104 passing through openings 248 in the members 240 and 242 and passing through openings 126 in the support bar 100. These clamping members 240 and 242 are illustrated in our U.S. application Serial No. 619,568 filed Oct. 6, 1975.

The smaller document hanging apparatus 62 and the rail adapter 60 are illustrated in FIG. 29. The rail adapter 60 has a central upward extending portion 250 which has a vertical slot 252 formed in the bottom thereof and extending longitudinally throughout the length of the rail adapter 60 to receive the rail 50 whereby the adapter 60 is supported. The adapter 60 also has a pair of horizontal flanges 254 and 256 extending the length of the adapter from the opposite sides of the central portion 250 with upward extending lips 258 and 260 formed on the outer edges of the flanges 254 and 256. The rail adapter 60 is formed from a rigid strong material such as extruder aluminum. The hanging apparatus 62 includes a hanging and attachment strip 264 with its length extending horizontally and its width extending vertically and formed from a tough, flexible, resilient material which has at least two identical spaced apertures indicated generally at 266 and 268 (the latter shown in FIG. 1) formed therein for receiving the respective rail adapters 60 and 61. Aperture 266 has a lower horizontally elongated portion 270 for receiving the flanges 254 and 256 of the adapter 60 and a vertically extending portion 272 for extending from a central segment of the lower portion 270 to the top edge of the strip 264. The aperture 266 forms in the hanging strip 264 a pair of wing portions 274 and 276 which extend toward each other over the flange portions 254 and 256. The hanging strip 264 also includes tab portions 278 and 280 extending downward from the inner ends of the wing portions 274 and 276 to interlock with the lips 258 and 260 and prevent the hanging member 264 from being pulled off of the adapter 60 by the weight of the documents as illustrated in FIG. 30. The tabs 278 and 280 extend downward a distance about equal to or slightly less than the height of the lips 258 and 260 so that the tabs touch the flanges 254 and 256 or are spaced slightly above the flanges. The lips 258 and 260 further are formed with inner surfaces 282 and 284, FIG. 30, which extend upward and inward to the top edges of the lips 258 and 260 to form sharp inner edges on the lips 258 and 260; these sharp inner edges engage the tabs 278 and 280 in the event of sufficient force on the strip 264 to hold the strip 264 on the rail adapter 60.

The rail adapter 61 is identical to the rail adapter 60 and cooperates with the other aperture 268 in an identical manner. Means such as a tight friction fit of the slot 252 in the adapters 60 and 61 on the rails 50 and 51 is provided to secure the adapters 60 and 61 on the rails 50 and 51.

For tolerance and permitting skewing, the adapter 60 and the aperture 266 is designed so that the inner edges of the tabs 278 and 280 and the wing portions 274 and 276 are spaced horizontally by a distance A from the central portion 250 of the adapter 60, the outer edges of the tabs 278 and 280 are spaced horizontally by a distance B from the inner edges of the lips 258 and 260, and the outer edges of the flanges 254 and 256 and lips 258 and 260 are spaced horizontally by a distance C from the strip border defined by the outer edges of the lower aperture portion 270 when the tabs 278 and 280 are equally spaced from the central portion 250. Preferably the distances A, B and C are all equal and substantially less than the horizontal width of the flanges 254 and 256 from the central portion 250. The attachment strip 264 can be readily removed from the rail adapters 60 and 61 by bending the wing portions 274 and 276 outward as illustrated in FIG. 31 to permit the hanging strip 264 to be removed below the rail adapter 60.

It is noted that by making the bottom edge of the lower aperature portion 270 a distance D below the bottom edges of the tabs 278 and 280 greater than the height E of the lips 258 and 260 above the bottoms of the flanges 254 and 256, only one of the wing portions 274 and 276 need be bent back and then downward to permit removal or placement of the hanging strip 264 on the adapter 60. The other wing portion and tab can be removed or placed over the adapter flange by lifting the strip 264 and moving the strip 264 such that the other tab passing over the corresponding lip of the flange.

The particular strip 264 illustrated in FIG. 29 is formed from a longitudinally folded strip which has halves 285 and 286 folded about a center line forming the top with the halves extending on opposite sides of the document 140 and secured by the staples 138 through the holes 136 in both halves 285 and 286. Alternately as shown in FIG. 32, an adhesive strip 287 is used to attach the document 140 to the strip 264 in the manner as illustrated in our patent 3,932,353. In a modified strip 288 shown in FIGS. 33 and 38 a single thickness of heavier or thicker tough, resilient flexible material is used instead of a folded strip; staples 138 are used in FIG. 33 while the adhesive strip 287 is used in FIG. 38. It is noted that with the single thickness strip 288, the adhesive strip 287 can be more narrow than in the folded strip 264 since the adhesive does not have to extend above the document 140 to secure opposite halves of the strip together. The strip 264 and 288 also include the openings 126 so that they may be used in the apparatus 52 as the attachment strips 102.

The employment of the adapters 60 and 61 with the longitudinal bottom slots 252 to receive the rails 50 and 51 and with the opposite flanges 254 and 256 permits greater flexibility in document hanging systems. Only one rail system need be employed and the user can select (1) the larger document hanging apparatus 52, 54, 56 or 58 for hanging large documents or bundles of documents, (2) the single sheet or small bundle hanging apparatus 66 for hanging small sheets or groups of documents, or (3) the improved single sheet or small bundle hanging apparatus 62 or 64 with the rail adapters 60 and 61 for hanging documents having a weight too great for the apparatus 66. Further these hanging apparatuses are all included in a single hanging system; the rail adapters 60 and 61 can be selected to only occupy a part of the rails 50 and 51 so that the remaining part of the rails 50 and 51 can be used to support hanging apparatus not requiring the flange means for hanging support.

A rail adapter variation 290, illustrated in FIG. 34, is formed from sheet metal which is bent into a shape similar to the adapter 60 in FIG. 29 except that the central portion of the adapter 290 does not extend as great a distance above the rail 50. Additionally, FIG. 34 illustrates the tabs 278 and 280 on the strip 264 having outer edges 292 and 294 which are cut at outward and downward flaring angles so as to form a more positive interlock with the inward extending surfaces 282 and 284 of the lips 258 and 260 of the adapter 290.

In a second variation 300 in FIG. 35 of the rail adapter, an insert 302 is included in the top portion of the longitudinal slot 303 to add load carrying strength to the rail 50. Also lips 304 and 306 on the adapter 300 extend vertically and are not bent inward as in the variation of FIG. 34.

In FIG. 36 there are illustrated a third rail adapter variation 310 and flexible attachment and hanging strip variation 312. The adapter 310 like the adapter in FIG. 34 has a center portion with a slot for receiving the rail 50 but has horizontal flanges 314 and 316 extending from the opposite sides thereof without any upward extending lips. The aperture 318 in the attachment and hanging strip variation 312 has a horizontal portion receiving the flanges 314 and 316 defining wing portions 320 and 322 of the strip 312 extending over the flange portions 314 and 316. The spaces between the inner edges of the wing portions 320 and 322 and the central portion of the adapter 310 as well as the spaces between the edges of the flanges 314 and 316 and the edges of the lower horizontal elongated portion of the aperture 318 are made substantially less than the horizontal width of the flanges 314 and 316 to prevent removal of the strip 312 without bending the wing portions 320 and 322 back.

In FIG. 37 a fourth adapter variation 324 has horizontally extending flanges 326 and 328 which have outer ends 330 and 332, respectively, extending at angles upwardly and outwardly on opposite sides of the adapter 324. In a hanging and fastening strip variation 334 the aperture 336 has a bottom portion which is formed horizontally elongated and at opposite sides extends upwardly and outwardly to mate with the flanges 326 and 328; thus wing portions 338 and 340 of the strip 334 extend downwardly and inwardly toward each other to form an interlock with the adapter 324.

The hanging and attachment strips 264 and 288 can be utilized with different rail means as shown in FIG. 38 which includes channel rail means indicated generally at 344. The rail means 344 has a horizontally extended flange or lower portion 348 and vertically upward extending lips 350 and 352 on the opposite edges of the main flange 348. The lips 350 and 352 cooperate with the tabs 278 and 280 to increase security of the hanging and attaching strip 288 on the rail means.

One portion of the compactor and holder 70 for the documents supported by hanging and attaching strips 62 and 64 on the rail adapters 60 and 61 is illustrated in detail in FIG. 39 showing only one end thereof. The rail adapter 60 includes spaced apertures or notches 356 formed in the top surface of the central portion 250 of the rail 60. The compactor 70 is a flat bar formed from rigid material such as extruded aluminum, and has a slot 358 cut from the bottom edge thereof to accomodate the central portion 250 of the adapter 60 with the slot being enlarged at 360 to receive the flanges 254 and 256 of the adapter 60. The notches 356 have width selected to receive the thickness of the compactor 70 and hold the compactor in a selected position on the adapters 60 and 61. This permits the compactor 70 to hold a group of the hanging apparatus 62 and 64 in a compacted condition. The compactor 70 can be lifted from the notches 356 and moved along the rail adapters 60 and 61 to slide and/or compact the hanging apparatus 62 and 64 to selected positions.

Figure 40:
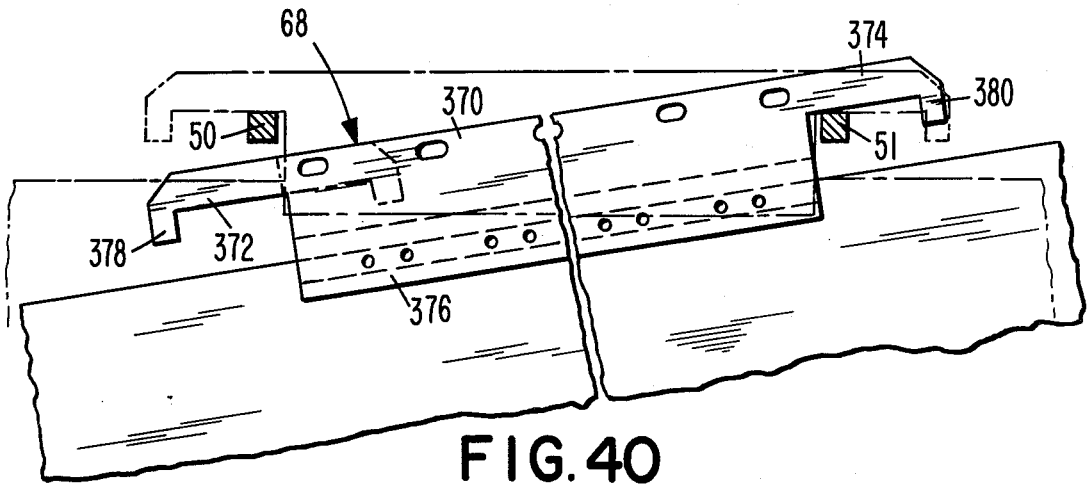
FIG. 40 is a front view of a modified hanging and attachment strip for use with small documents and hanging on the rails in the system of FIG. 1.
Figure 41:
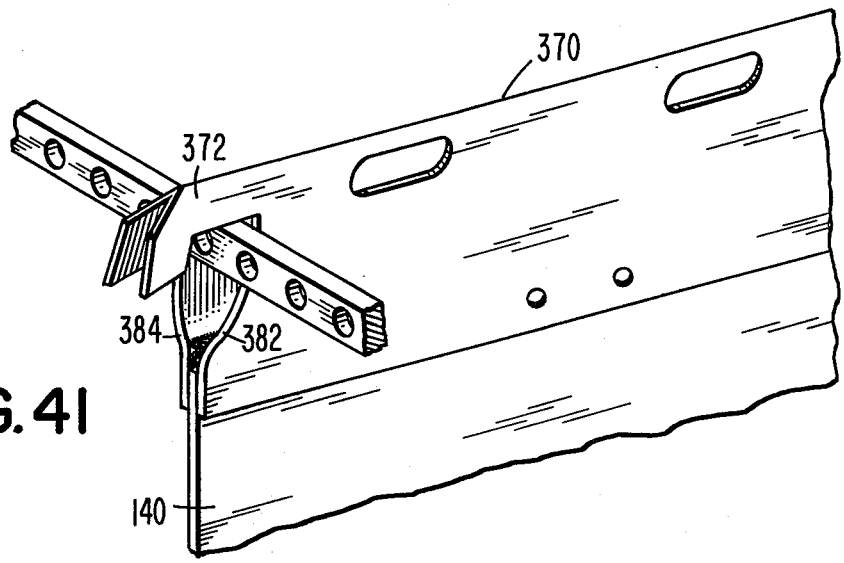
FIG. 41 is a perspective view of a broken-away portion of the modified hanging and attachment strip of FIG. 40.

A modified hanging and attachment strip 370, illustrated in FIGS. 40 and 41, is formed from a folded, tough, resilient, and flexible material with its length extending horizontally and its width extending vertically and has ends cut to form upper end portions 372 and 374 of reduced width for extending over the tops of the rails 50 and 51. A central portion 376 between the end portions 372 and 374 contains the attachment means, such as holes for receiving staples, adhesive, and the like, for securing a document to the hanging and attachment strip 370, and has a vertical width substantially greater than the width of the end portions 372 and 374 to extend downward between the rails 50 and 51. Downward extending tabs 378 and 380 are formed on the ends of the overhanging portions 372 and 374 to engage the outer sides of the rails 50 and 51 to prevent the hanging strip 370 from falling from the rails 50 and 51. As illustrated in FIG. 41 opposite halves 382 and 384 of the folded strip 370 are flared apart so that the halves of upper end portion 372 flare apart from the top edge which is the fold line of the folded strip. The flaring apart of the halves of the upper end portions 372 and 374 substantially increases the strength and the resistance of the end portions from being bent due to the weight of the document. The flexibility of the strip 370 permits the end portions 372 and 374 to be bent inwardly inside of the rails 50 and 51 permitting the attachment strip 370 to be removed from below the rails 50 and 51 as shown in FIG. 40.

Figure 42:
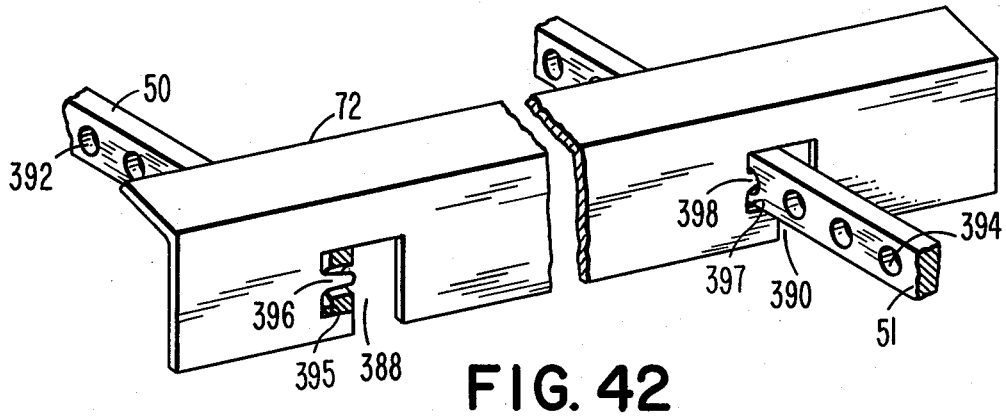
FIG. 42 is a perspective view of a compactor with a center portion broken away for compacting documents on the rails in the system of FIG. 1.

Illustrated in FIG. 42 is the compactor 72 for compacting and holding the hanging apparatus 66 and 68, FIG. 1, on the rails 50 and 51. The compactor 72 is formed from a strip of rigid material such as metal which extends horizontally and has slots 388 and 390 extending vertically from the bottom edge of the compactor 72. The rails 50 and 51 are generally rectangular with their longest dimension vertically and have horizontal apertures or holes 392 and 394 respectively formed therethrough. The compactor 72 has recesses 395 and 397 formed to one side at the top portions of the slots 388 and 390 for receiving the rails 50 and 51 when the compactor 72 is moved longitudinally, and has horizontal tangs 396 and 398 in the recesses 395 and 397 for extending into the holes 392 and 394 to interlock with the rails 50 and 51. Thus the compactor 72 like the compactor 70 can be locked in place on the rails 50 and 51 to hold the hanging apparatus 66 and 68 in a compacted condition.

Since the invention is subject to many variations, modifications, and changes in detail, it is intended that all matter in the foregoing description or shown in the accompanying drawings be interpreted as illustrative and not in a limiting sense.

What is claimed is:

1. A document hanging system for use in hanging documents upon a pair of spaced horizontal rails, the system comprising a rigid strip-like supporting bar having an upper load carrying portion with ends adapted to overhang and be supported by the rails, the width of said support bar extending vertically, said supporting bar having a lower document supporting portion with a plurality of spaced openings and extending downward between the rails, document attachment means having a plurality of spaced openings with the same spacing as the supporting bar openings, a plurality of flexible straps each having head portions at the opposite ends thereof and passing through the corresponding openings in both the supporting bar and document attachment means, said head portions of each strap interlocking with at least one of the corresponding openings in the supporting bar and document attachment means, and means for fastening a document to the document attachment means.

2. A document hanging system as claimed in claim 1 wherein the document attachment means is a tough, resilient, flexible strip.

3. A document hanging system as claimed in claim 2 wherein the means for fastening a document to the document attachment means includes a plurality of staple holes in the flexible strip.

4. A document hanging system as claimed in claim 2 wherein the means for fastening a document to the document attachment means includes a strip of adhesive on the flexible strip.

5. A document hanging system as claimed in claim 1 wherein the head portions at the opposite ends of the flexible straps form shoulders extending on opposite sides of the straps, and the one openings have vertical portions with a horizontal width less than the width of the head portions but greater than the width of the strap.

6. A document hanging system as claimed in claim 5 wherein both head portions of each strap are interlocked with a corresponding opening in the supporting bar.

7. A document hanging system as claimed in claim 5 wherein one head of each strap is interlocked with an opening in the supporting bar and the other head portion of each flexible strap is interlocked with an opening in the document attachment means.

8. A document hanging system as claimed in claim 1 wherein the document attachment means includes a pair of clamping members and means for securing the clamping members together for securing a plurality of documents therebetween.

9. A document hanging system as claimed in claim 1 wherein the document attachment means includes a rigid bar for supporting a document folded thereover.

10. A document hanging system for use in hanging documents upon a pair of of spaced horizontal rails, the system comprising a rigid strip-like supporting bar having an upper load carrying portion with ends adapted to overhang and be supported by the rails;

the width of said support bar extending vertically;

said supporting bar having a lower document supporting portion with a plurality of spaced openings and extending downward between the rails;

document attachment means having a plurality of spaced openings with the same spacing as the supporting bar openings;

a plurality of flexible straps each having head portions at the opposite ends thereof and passing through the corresponding openings in both the supporting bar and document attachment means;

said head portions of each strap interlocking with at least one of the corresponding openings in the supporting bar and document attachment means;

means for fastening a document to the document attachment means; and said document attachment means including a rigid extension bar having first openings for receiving the plurality of flexible straps passing through the openings in the supporting bar, said extension bar also having second strap receiving openings in the ends thereof, a rigid fold bar having openings in the opposite ends thereof corresponding to the second openings in the extension bar to support a document folded thereover, and a pair of flexible straps having head portions at the opposite ends thereof and passing through the second openings in the ends of the extension bar and the openings in the fold bar and being interlocked therewith.

11. A document hanging system for use in hanging documents upon a pair of spaced horizontal rails, the system comprising a rigid strip-like supporting bar having an upper load carrying portion with ends adapted to overhang and be supported by the rails;

the width of said support bar extending vertically;

said supporting bar having a lower document supporting portion with a plurality of spaced openings and extending downward between the rails;

document attachment means having a plurality of spaced openings with the same spacing as the supporting bar openings;

a plurality of flexible straps each having head portions at the opposite ends thereof and passing through the corresponding openings in both the supporting bar and document attachment means, said head portions of each strap interlocking with at least one of the corresponding openings in the supporting bar and document attachment means;

means for fastening a document to the document attachment means; and the document attachment means including a rigid extension bar having a length substantially greater than the supporting bar with openings intermediate the ends of an upper portion thereof for receiving the plurality of flexible straps passing therethrough and through the openings in the supporting bar, said extension bar also having strap receiving openings at the ends thereof, a rigid fold bar having openings in the opposite ends thereof corresponding to the openings in the opposite ends in the extension bar to support a document folded thereover, and a pair of flexible straps having head portions at the opposite ends thereof and passing through the openings in the ends of the extension bar and fold bar and being interlocked therewith.

12. A document hanging system comprising a horizontal rail, an elongated rail adapter having a longitudinal slot for receiving the rail and having horizontal flanges extending from opposite sides thereof, elongated flat document attachment means with its length extending horizontally and its width extending vertically, said document attachment means formed from a tough, resilient, flexible planar material and having an aperture for receiving the horizontal flanges of the adapter, said aperture including a horizontally elongated lower aperture portion in which the horizontal flanges extend and including a vertical aperture portion extending from an intermediate section of the lower aperture portion to the top edge of the document attachment means, said document attachment means including a pair of wing portions bordering the aperture, said wing portions extending toward each other above the respective flanges of the rail adapter, and means for fastening a document to the document attachment means.

13. A document hanging system comprising a pair of spaced horizontal rails with rectangular cross sections, a pair of elongated rail adapters each having a longitudinal slot for receiving the respective rail and having horizontal flanges extending from opposite sides thereof, elongated flat document attachment means with its length extending horizontally and its width vertically, said document attachment means formed from a tough, resilient, flexible planar material and having at least two spaced apertures for receiving the horizontal flanges of the adapters, said apertures each including a horizontally elongated lower aperture portion in which the horizontal flanges extend and including a vertical aperture portion extending from an intermediate section of the lower aperture portion to the top edge of the document attachment means, said document attachment means including two pairs of wing portions bordering the respective apertures, each pair of wing portions extending toward each other above a respective pair of the flanges of the rail adapters and means for fastening a document to the document attachment means.

14. A document hanging system as claimed in claim 12 wherein the document attachment means includes a folded strip with the fold at the top edge thereof and the aperture extending through both folded halves.

15. A document hanging system comprising a pair of spaced horizontal rail means each including horizontal flange means with upward extending lips on the outside edges of the flange means, elongated flat document attachment means with its length extending horizontally and its width extending vertically, said document attachment means formed from a tough, resilient flexible material and having a pair of spaced apertures for receiving the respective rail means, said apertures each including a horizontally elongated aperture portion for receiving the horizontal flange means of the rail means and a vertical aperture portion extending from an intermediate section of the horizontally elongated aperture portion to the top edge of the document attachment means, said document attachment means including two pair of winged portions each pair extending toward each other above a respective flange means of the pair of rail means, each of the winged portions having a downward extending tab of the inner edge thereof for interlocking with the corresponding lip of the flange means, and means for fastening a document to the document attachment means.

16. A document hanging system as claimed in claim 15 wherein the inner edges of the lips on the rail flange means extend upward and inward toward each other.

17. A document hanging system comprising a pair of horizontal rails with rectangular cross sections, a pair of elongated rail adapters having respective longitudinal slots for receiving the rails and having pairs of horizontal flanges extending from opposite sides thereof with upward extending lips on the outside edges of the flanges, elongated flat document attachment means with its length extending horizontally and its width extending vertically, said document attachment means formed from a tough, resilient flexible material and having a pair of spaced apertures for receiving the respective rail adapters, said apertures each including a horizontally elongated aperture portion for receiving the horizontal flanges of the rail adapters and a vertical aperture portion extending from an intermediate section of the horizontally elongated aperture portion to the top edge of the document attachment means, said document attachment means including two pairs of winged portions each pair extending toward each other above a respective pair of flanges of the pair of rail adapters, each of the winged portions having a downward extending tab of the inner edge thereof for interlocking with the corresponding lip of the flanges, and means for fastening a document to the document attachment means.

18. A document hanging system as claimed in claim 15 wherein the horizontal rail means includes a pair of U-shaped channels with the bottom portion thereof forming the horizontal flange means and the sides thereof forming the upward extending lips on the outside edges of the flange means.

19. A document hanging system comprising a pair of spaced horizontal rails, an elongated document hanging member formed from a tough, resilient, flexible strip folded longitudinally, said hanging member having its length extending horizontally and its width extending vertically with the folded edge at the top and forming a document receiving slot at the bottom, said hanging member having opposite end portions at the folded edge extending over the respective rails with a width of the end portions substantially less than the width of the central portion of the hanging member and having tabs extending downward outside the rails, said end portions of the hanging member each including folded portions of the strip which flare apart from the folded edge to engage the respective rail, and means for fastening a document to the hanging member.

20. A document hanging system comprising a pair of spaced horizontal rail means each including spaced apertures along the length thereof, a plurality of document hanging apparatus across the rail means, a rigid strip-like compactor having a pair of slots for receiving the rail means, and said compactor including means for interlocking with the apertures in the rail means to hold the plurality of hanging apparatus in a compacted position on the rail means.

21. A document hanging system as claimed in claim 20 wherein the apertures in the horizontal rail means are notches formed in the top surface thereof, and said means for interlocking with the apertures includes a portion of the compactor above the slots therein for interlocking with the notches in the rail means.

22. A document hanging system as claimed in claim 20 wherein the rail means include a pair of rails with rectangular cross sections having horizontal holes therethrough, and the compactor means including horizontal tangs extending from the sides of the slot to engage the holes in the rails.

23. A document hanging system comprising a pair of spaced horizontal rails, a rigid strip-like supporting bar having an upper load carrying portion with ends adapted to overhang and be supported by a first section of the rails, the width of said support bar extending vertically, said supporting bar having a lower document supporting portion with a plurality of spaced openings and extending downward between the rails, document attachment means having a plurality of spaced openings with the same spacing as the supporting bar openings, a plurality of flexible straps each having head portions at the opposite ends thereof and passing through the corresponding openings in both the supporting bar and document attachment means, said head portions of each strap interlocking with at least one of the corresponding openings in the supporting bar and document attachment means, means for fastening a document to the document attachment means, a pair of elongated rail adapters each having a longitudinal slot for receiving a second section of the respective rails and having horizontal flanges extending from opposite sides thereof, elongated flat document hanging means with its length extending horizontally and its width extending vertically, said document hanging means formed from a tough, resilient, flexible planar material and having at least two spaced apertures for receiving the horizontal flanges of the adapters, said apertures each including a horizontally elongated lower aperture portion in which the horizontal flanges extend and including a vertical aperture portion extending from an intermediate section of the lower aperture portion to the top edge of the document hanging means, said document hanging means including two pairs of winged portions bordering the respective apertures, each pair of winged portions extending toward each above a respective pair of the flanges of the rail adapters, and means for fastening a document to the document hanging means.

24. A document hanging system as claimed in claim 23 including an elongated document hanging member formed from a tough, resilient, flexible strip folded longitudinally, said hanging member having its length extending horizontally and its width extending vertically with the folded edge at the top and forming a document receiving slot at the bottom, said hanging member having opposite end portions at the folded edge extending over third sections of the respective rails with a width of the end portions substantially less than the width of the central portion of the hanging member and having tabs extending downward outside the rails, said end portions of the hanging member each including folded portions of the strips which flare apart from the folded edge to engage the rail, and means for fastening a document to the hanging member.

25. A document hanging system as claimed in claim 23 including apertures in the rail adapters, a rigid strip-like compactor having a pair of slots for receiving the rail adapters, and said compactor including means for interlocking with the apertures in the rail adapters to hold a plurality of the document hanging means in a compacted position on the rail adapters.

26. A document hanging system as claimed in claim 23 including a pair of reinforcing bars extending above and parallel to the rails, and means intermediate the ends of the bars and rails for securing the rails to the bars.

27. A document hanging system for use in hanging a document upon a pair of spaced horizontal rails, the system comprising a rigid strip-like supporting bar having an upper load carrying portion with means adapted to overhang and be supported by the rails, the width of said support bar extending vertically, said supporting bar having a lower document supporting portion with a plurality of spaced openings and extending downward between the rails, a plurality of flexible straps each having head portions at the opposite ends thereof and passing through the corresponding openings in the supporting bar, one of said head portions of each strap interlocking with the corresponding openings in the supporting bar, and means securing the other head portion of each strap to the document whereby the document depends by the flexible straps on the support bar.

28. A document hanging system for use in hanging a document upon a pair of spaced horizontal rails, the system comprising a rigid strip-like supporting bar having an upper load carrying portion with means adapted to overhang and be supported by the rails, the width of said support bar extending vertically, said supporting bar having a lower document supporting portion with a plurality of spaced openings and extending downward between the rails, document attachment means on the document and defining a plurality of spaced openings with the same spacing as the supporting bar openings, a plurality of flexible straps each having head portions at the opposite ends thereof and passing through the corresponding openings in both the supporting bar and document attachment means, and said head portions of each strap interlocking with at least one of the corresponding openings in the supporting bar and document attachment means.

29. A document hanging system comprising horizontal rail means including horizontal flange means with upward extending lips on the outside edges of the flange means, document attachment means formed from a tough, resilient flexible material and having an aperture for receiving the rail means, said aperture including a horizontally elongated aperture portion for receiving the horizontal flange means of the rail means and a vertical aperture portion extending from an intermediate section of the horizontally elongated aperture portion to the top edge of the document attachment means, said document attachment means including a pair of winged portions extending toward each other above the flange means of the rail means, each of the winged portions having a downward extending tab on the inner edge thereof for interlocking with each corresponding lip of the flange means, and means for fastening a document to the document attachment means.

* * * * *